United States Patent [19]

Klassen

[11] 4,133,457

[45] Jan. 9, 1979

[54] SQUEEZE BOTTLE WITH VALVE SEPTUM

[76] Inventor: Edward J. Klassen, 17331 Tramonto Dr., No. 6, Pacific Palisades, Calif. 90272

[21] Appl. No.: 767,525

[22] Filed: Feb. 10, 1977

Related U.S. Application Data

[63] Continuation-in-part of Ser. No. 664,515, Mar. 8, 1976, abandoned.

[51] Int. Cl.[2] ..... B65D 35/52

[52] U.S. Cl. ..... 222/212; 222/481; 222/490; 222/494; 137/849

[58] Field of Search ..... 222/212, 213, 490, 494, 222/481; 137/849

[56] References Cited

U.S. PATENT DOCUMENTS

| | | | |
|---|---|---|---|
| 3,410,460 | 11/1968 | Musher | 222/490 |
| 3,674,183 | 7/1972 | Venable | 222/490 X |

FOREIGN PATENT DOCUMENTS

| | | | |
|---|---|---|---|
| 1203220 | 7/1959 | France | 222/494 |

*Primary Examiner*—Robert B. Reeves
*Assistant Examiner*—Frederick R. Handren
*Attorney, Agent, or Firm*—Frederick E. Mueller

[57] ABSTRACT

A liquid dispenser bottle of a resiliently flexible material has a relatively thin, resiliently flexible septum of circular planform seated on and spanning the dispenser outlet, peripherally sealingly clamped in place by a dispenser nozzle cap. The septum has a 90° butt cut slit formation defining at least one resiliently flexible valve flap integrally joined along a hinge line area to the septum proper for outward deflection of the flap by internal liquid pressure when the dispenser is squeezed. The septum is also formed with at least one tiny hole, preferably on or in the vicinity of the hinge line area to increase flexibility of the valve flap, to serve as a vent to greatly accellerate relaxation and normalization of the squeeze bottle wall.

14 Claims, 9 Drawing Figures

Fig. 1
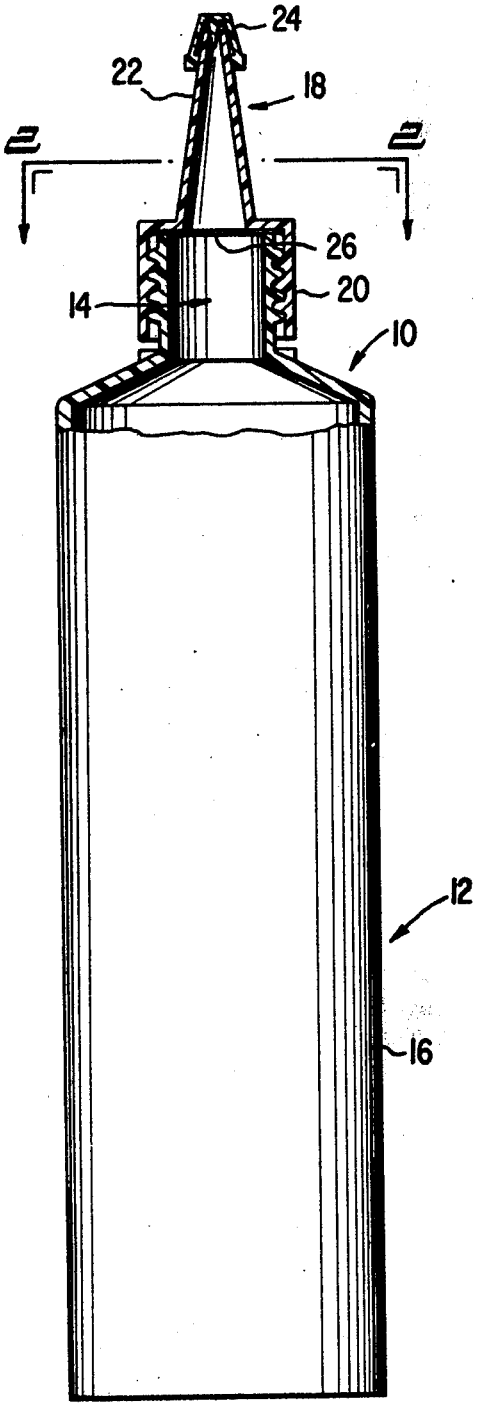
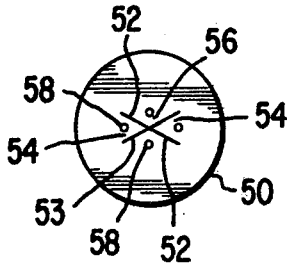
Fig. 7
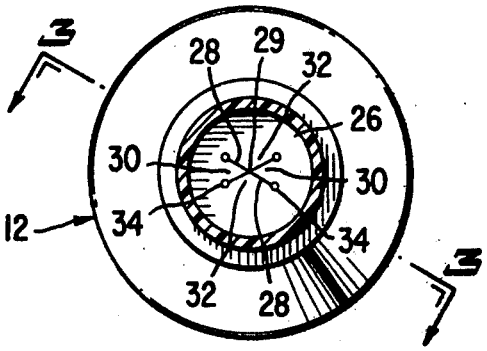
Fig. 2
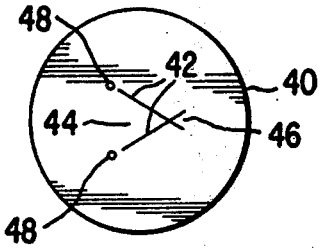
Fig. 6

SQUEEZE BOTTLE WITH VALVE SEPTUM

This is a continuation-in-part of my application, Ser. No. 664,515 filed March 8, 1976 for "SQUEEZE BOTTLE WITH AUTOMATICALLY CLOSABLE DISCHARGE VALVE", now abandoned.

BACKGROUND OF THE INVENTION

Field of the Invention

In simple squeeze bottles, consisting of a resiliently flexible squeeze bottle proper and a spout member threaded on the bottle neck, there is no barrier to the ejection of the liquid nor to the intake of air for relaxation of the bottle. However, the simple structure is hazardous or disadvantageous in several respects, e.g., if such a squeeze bottle dispenser with an open dispensing outlet is accidentally tipped over or dropped, the liquid contents will drain. The resulting spill may be very troublesome to clean up in the case of some liquids, such as greasy or sticky liquids and, in the case of other liquids, such as solvents, may damage the surface on which the spill occurs, or the spill may create a slippery hazard.

A variety of squeeze bottle outlet closure sealing arrangements have been devised in efforts to avoid or eliminate these defects of the simple basic structure. These prior art structures are satisfactory to some extent in rendering a squeeze bottle dispenser spill-proof by disposing a valved barrier in the outlet. However, none of these barrier structures appears to have been satisfactory since these structures typically greatly inhibit the expulsion of the contained liquid through the barrier, greatly retard the relaxation of the elastic squeeze bottle, or they may be prohibitively expensive. Thus, the device of Venable U.S. Pat. No. 3,674,183 involves a valve disc having a sinuous slit cut at an angle with respect to the face of the disc which, irrespective of its efficiency as a valve, appears impractical for purposes of mass production. Musher U.S. Pat. No. 3,410,460 discloses a barrier having a simple diametrically disposed slit which, if employed in a liquid dispenser bottle, would be totally impractical in too greatly inhibiting both dispensing of the contained liquid and admission of ambient air in order to permit relaxation of a squeeze bottle. For the same reasons, the various slit configurations of Flax French Pat. No. 1,203,220 are impractical, even if employed in a sufficiently thin resilient membrane to constitute the desired barrier. The various devices of Susuki et al., U.S. Pat. No. 3,360,169 appear to be fairly effective in terms of admitting ambient air for relaxation of the bottle. However, the various geometrics of the disclosed double-layer device, and the double-layer construction itself, appear to be totally impractical for efficient low cost mass production and present sealing, assembly and filling problems.

SUMMARY OF THE INVENTION

This invention provides an improved, spill-proof squeeze bottle liquid dispenser and flap valve insert therefor which avoids the above noted and other disadvantages of the existing squeeze bottle dispensers. More particularly, the invention provides a highly effective and inexpensive valve septum structure which in performance very closely approximates the complete cycling time, i.e., the total of delivery rates and relaxation rates, of squeeze bottle dispensers not utilizing any barrier at all. To this end, the squeeze bottle dispenser of this invention embodies a relatively thin resiliently flexible valve septum which sealingly spans the dispenser outlet and contains a slit formation defining at least one integral resiliently flexible valve flap in combination with at least one hole at or in the region of the valve flap hinge. Preferably, the slit formation comprises a pair of symetrically arranged intersecting straight line 90° butt cut slits defining equal opposite included angles on the order of 55° constituting the valve flap areas. Preferably, the holes are arranged such that there is a hole at each end of each slit. Alternatively, the holes may be offset outwardly relative to the valve flap areas and other specific combinations of slits and of holes disposed along or offset from the slit lines may be devised.

The apex angle, the length of the valve flap, the size of the vent or breather holes, and the thickness and elasticity of the septum material are determined by the viscosity of the liquid to be dispensed and are selected to provide a dispenser which will operate in the desired manner and yet resist outflow of liquid if the dispenser is accidentally tipped over, dropped, or even held in an inverted position. The preferred dispenser also has a cap for closing the dispenser spout when not in use, particularly if the liquid to be dispensed is glue or other liquid which sets or hardens upon exposure to air. The flap valve septum of the described squeeze bottle dispenser is a disc shaped insert of circular planform confined and sealingly clamped between the dispenser squeeze bottle neck and spout member.

BRIEF DESCRIPTION OF THE DRAWINGS

FIG. 1 is a side elevation, partly in section, of a spill proof squeeze bottle liquid dispenser according to this invention.

FIG. 2 is an enlarged section taken on line 2—2 in FIG. 1 showing in particular the outer face of the flap valve septum and its valve flap in normal, unstressed, closed position.

FIG. 6 illustrates a modified septum slit formation.

FIG. 7 illustrates another modified septum slit formation.

DESCRIPTION OF THE INVENTION

Figure 3:
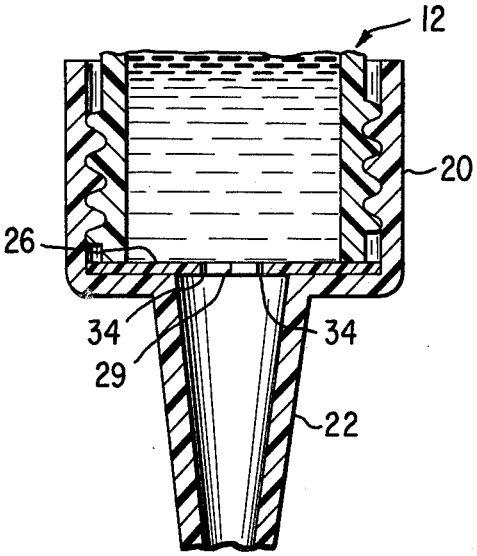
FIG. 3 is a section taken on line 3—3 in FIG. 2 again showing the valve flap in its, closed position, with the bottle inverted.
Figure 4:
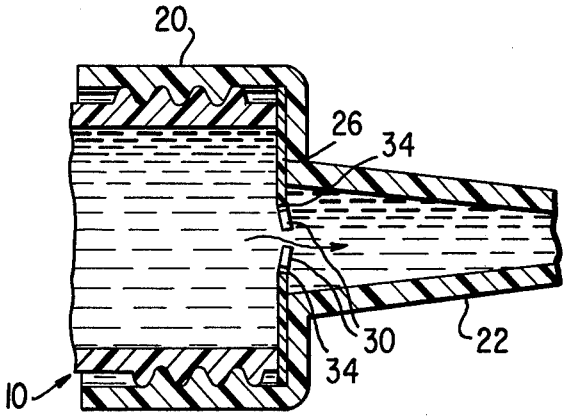
FIG. 4 is a section similar to FIG. 3 showing the valve flap deflected outwardly during dispensing of liquid from the dispenser.
Figure 5:
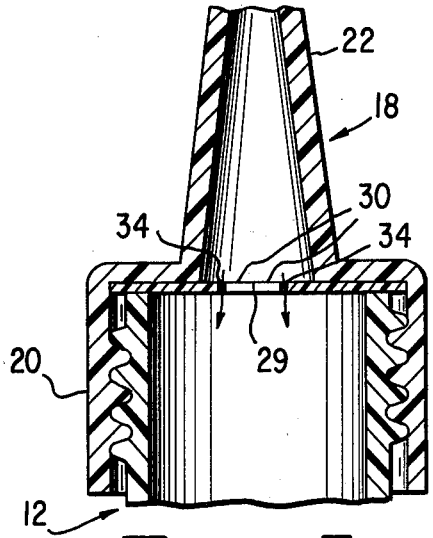
FIG. 5 is a view like FIG. 3 with the bottle in erect position.

Turning first to FIGS. 1-5, the illustrated spillproof squeeze bottle liquid dispenser assembly 10 comprises a generally cylindrical molded plastic squeeze bottle 12 having a resiliently flexible container wall 16 and is integrally formed at its upper end with an externally threaded outlet neck 14. The assembled bottle 10 also includes a molded plastic spout member 18 having a generally cylindrical lower end portion 20 that is internally threaded for mounting on the external threads of the bottle neck 14. The tip of a tapered portion 22 of the spout is normally closed by a complementary cap 24 which is, of course, removed when it is desired to dispense a liquid contained in the bottle.

As is well known, inward manual deflection of the wall 16 creates or stores elastic strain energy in the wall which returns the wall outwardly to its illustrated unstressed normal shape after pressure is removed from the wall. Air is drawn into the container through its outlet neck 14 during this outward return of the wall 16 to equalize the internal container pressure and external ambient pressure and thereby permit full return of the wall to its normal shape. Without any further structure, the squeeze bottle dispenser thus far described is entirely conventional and subject to the deficiencies previously noted.

According to the present invention, spilling hazards are eliminated by providing the dispenser with a unique and simple valved and vented septum which prevents outflow of liquid from the dispenser except when it is deliberately squeezed but without the septum's appreciably inhibiting the dispensing rates or relaxation rates of the bottle.

Preferably, the septum takes the form of the particular septum 26 shown in FIG. 2, but in all cases is made as a thin self-supporting membrane of a resiliently flexible material with a perimeter matching that of the outlet on which it is to be seated. Thus, as is shown in FIG. 1, the septum 26 is seated on the upper end of the outlet neck 14 and fluid-sealingly clamped in place spanning the outlet by means of the screw connection of the spout 18 with the bottle neck. In the illustrated case, the septum 26 is of circular plan-form and the membrane thickness of the resiliently flexible septum is nevertheless sufficient to be sufficiently self-supporting to span the opening and provide a solid barrier to the passage of the liquid except in response to the valve action.

The preferred septum 26 has a pair of slits 28 intersecting at 29 at the geometric center of the septum disc and, thus, the longitudinal axis of the dispenser spout. The pair of slits 28 are angularly oriented relative to one another such that they include equal opposite angles in the range of about 35° to about 65°, but preferably on the order of 55° defining an opposite pair of symmetrical valve flaps 30.

The intersecting slits 28 also define another opposite pair of equal angles of 125°, each of these areas comprising secondary flaps 32. At both ends of each slit 28, the septum 26 is formed with circular hole perforations 34 intersected by the slit. These holes are preferably centered with respect to the slits 28, although not necessarily so. In any case, the hole-slit intersection eliminates binding of the valve flaps 30 at their root edges during valve action.

The valve flaps 30 and the secondary flaps 32 have isosceles triangular shapes. However, the valve flaps 30 are relatively long and have short hinges, as compared to the secondary valve elements 32 and are therefore more flexible — that is, the apices of the valve flaps 30 are more readily deflectable than the apices of the secondary flaps 32. It will be understood that the hinge areas of all these flap elements correspond to the base of the respective triangular areas. In the case of the septum 26, by virtue of the presence of the holes 34, the length of the hinge line, most notably of the short hinge lines of the valve flaps 30, is reduced accordingly. The valve flaps 30 are thus made more flexible for turning about their hinge line areas by virtue of presence of the holes 34.

The septum 26 is shown essentially full scale and to scale in FIG. 2 (except for exaggeration of the size of holes 34 for clarity), and represents a specimen of the invention which is particularly suitable for use with liquids such as household detergents. In particular, the septum 26 illustrated in FIG. 2 has been employed in a one-inch diameter made out of polyethylene-MILP-22033 MIC-SPGC, of a thickness of 0.020 inches, with a flap 30 apex angle of 55° and a flap edge length on the order of ¼ inch. It will be understood that the 90° butt cut slit edges of the flap fit closely within the complementary V-shaped opening of the septum from which the flap is severed. The holes 34 each have a diameter of 1/32 of an inch to be porous with respect to air but non-porous with respect to the contained liquid. The septum 26 afforded practically no resistance to the desired expulsion of detergent out of the dispenser bottle and very closely approximated the relaxation time which would be true of the same bottle without the septum. At the same time, in all attitudes of the bottle, i.e., inverted or turned 90°, as in FIGS. 3 and 4, no leakage or spillage of detergent of the ¾ full bottle occurred, even through the holes 34.

When the dispenser 10 is not in use, its container 12 occupies the normal shape illustrated in FIG. 1 and the internal container pressure and the external ambient pressure are equal. Under these conditions, all of the flaps of the septum 26 occupy their normal closed position within the plane of the body of the septum to block liquid outflow from the dispenser through its outlet 14 if the dispenser is tipped over or dropped or held in an inverted position.

Assume now that the dispenser is tilted or inverted and its container wall 16 squeezed in the usual way. Resultant inward deflection of the container wall first exhausts internal air through the openings 34 until sufficient air has been displaced to bring the liquid into contact with the inner surface of the septum. Thereafter, upon continued pressure being applied, the valve flaps 30 are deflected outwardly creating an opening through the septum 26. The other secondary flaps 32 may also yield outwardly slightly but the primary valving action occurs as a result of the outward flexing of the primary valve flaps 30. Dispensing occurs with far less pressure since only the resistance of the short hinge, relatively long valve flaps 30 needs to be overcome rather than the total resistance of the four flaps 30, 32.

When pressure on the container wall is released, outward elastic strain energy return of the wall 16 to its normal shape induces intake of ambient air through the holes 34 and into the container. Concurrently, the valve flaps 30 return to closed position and, in some cases, may be flexed inwardly as a result of the intake of ambient air therethrough. However, the primary intake of air probably occurs due to the presence of the holes 34 and the container wall 16 very quickly returns to its unstressed relaxed tubular cylindrical configuration of FIG. 1 upon equalization of the internal and external pressures. In any event, the holes 34 in the specific slit-hole combinations of the septum 26 result in a sevenfold improvement in the bottle relaxation time.

An alternative form of septum 40 is shown in FIG. 6 which is in all respects like the septum 26 except for the valve defining slit formation and the relationship of the holes to the slits. More specifically, an intersecting pair of slits 42 define an included angle on the order of 55° thus defining an isosceles triangularly shaped valve flap portion 44 and an opposite equal angle stub flap 46. The valve flap 44 is defined in the central region of the septum 40 such that the central portion of the flap is in alignment with the longitudinal central axis of the bottle in which it is to be mounted. Adjacent the hinge line area of the valve flap 44 but offset from adjacent ends of the pair of slits 42 are a pair of holes 48 which, as before, may be 1/32 of an inch in diameter.

In the case of the septum 40 it will be observed that there is essentially but a single valve element, i.e., the relatively most flexible triangular flap area 44. While in this case the holes 48 are offset slightly relative to a straight hinge line extending between base ends of the slits 42, i.e., essentially the base of the isosceles triangle, the removal of the material of the holes 48 nevertheless increases the flexibility of the valve flap 44 so that once again the septum 40 defines an effective barrier against undesired leakage without unduly impeding either exhaustion or dispensing of liquid through the valve flap or quick relaxation of the squeeze bottle by virtue of the presence of the holes 48. The stub flap 46 flexes slightly with the valve flap 44 to avoid catching of the valve tip in the apex of the valve opening.

Another embodiment of the invention is shown in FIG. 7. In this case, the septum 50 is provided with a pair of slits 52 intersecting at 53 at the geometric center of the circular planform septum, thus defining two primary valve flaps 54 that are opposite equal included angle areas of 55°. In this case, there are also secondary triangular long hinge flap areas 56 of 125° which, again, are relatively stiff as compared to the primary valve flaps 54. In this instance, each of these four triangular flap areas, at essentially the midpoint of its hinge line area, has a perforation 58, in this instance, constituting holes 1/32 of an inch in diameter.

Figure 8:
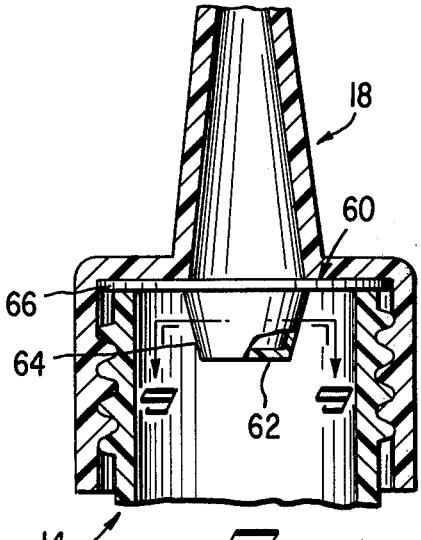
FIG. 8 is a section through yet another modified flap valve septum for the present squeeze bottle dispenser.
Figure 9:
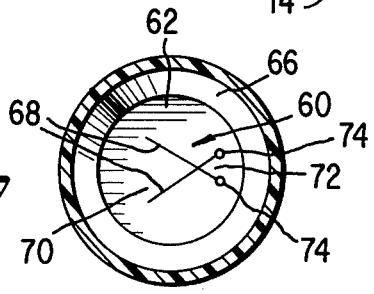
FIG. 9 is a section taken on line 9—9 in FIG. 8.

The modified flap valve insert 60 of FIGS. 8 and 9 is also of one-piece construction. In this case there is a circular planform septum 62 defining the floor of a cup shaped cavity 64 formed at its upper end with an annular flange 66 which is clamped between the spout 18 and neck 14 of the bottle. As is shown in FIG. 9, an intersecting pair of slits 68 include an angle of preferably 55°, the isosceles triangle flap area constituting a primary valve flap 70, oppositely to a stub flap area 72. As in the case of the embodiment shown in FIG. 6, the two opposite equal angle 125° areas are essentially stiff as compared to the flexibility of the primary valve flap 70. In this case a pair of 3/64 inch holes 74 are provided in the stub flap area 72 at the ends of the slits. Concentration of the liquid at the slit formation of the septum 62 provides maximum return of the liquid inwardly upon relaxation of the bottle.

I claim:

1. A spill-proof squeeze bottle liquid dispenser comprising:

a liquid container having an outlet opening to the exterior of said container and a resiliently flexible wall adapted to be deflected inwardly to expel liquid from the container through said outlet and then released for elastic strain energy return to its normal shape with resultant air inflow to the container through said outlet;

a septum of relatively thin resiliently flexible material spanning said outlet and containing a substantially 90° butt cut slit formation defining a resiliently flexible tongue-like valve flap integrally joined along a hinge line area to the septum proper for outward and inward deflection of said flap from the plane of said septum to provide a liquid flow opening through said septum complemented by said flap;

said valve flap having a closed normal unstressed position within said septum liquid flow opening substantially coplanar with the septum wherein the flap complements and seals said liquid flow opening against liquid passage therethrough, whereby said flap is deflected outwardly from said normal position by internal liquid pressure when said container wall is deflected inwardly to permit expulsion of liquid from the container through said outlet, and said flap is returned to its normal position by elastic strain energy to block passage of liquid from the container through said outlet upon equalization of the internal container pressure and ambient air pressure;

and an air flow opening in said septum of a cross-sectional area that is porous with respect to the passage of air and non-porous with respect to the passage of the contained liquid.

2. A liquid dispenser according to claim 1, wherein:

said air flow opening is in said hinge line area of said valve flap.

3. A liquid dispenser according to claim 2, wherein:

said flap has side edges defined by two narrow slits cut into said septum which intersect at a free flap end.

4. A liquid dispenser according to claim 3, wherein:

said two slits cross and extend beyond their intersection.

5. A liquid dispenser according to claim 1, wherein:

said valve flap and septum liquid flow opening have complementary generally isosceles triangular shapes and side edges which converge to an apex at a free end of said flap;

said side edges are defined by two narrow slits in said septum which intersect at said free flap end;

said septum comprises polyethylene plastic on the order of 0.020 inches in thickness; and said septum liquid flow opening and valve flap have an apex angle in the range of 45° to 65° and a length on the order of ¼ inch measured along said side edges.

6. A liquid dispenser according to claim 1, wherein:

said valve flap and septum liquid flow opening have complementary generally isosceles triangular shapes and side edges which converge to an apex at a free end of said flap;

said side edges are defined by two narrow slits in said septum which intersect at said free flap end;

said septum comprises polyethylene plastic on the order of 0.020 inches in thickness; and said septum liquid flow opening and valve flap have an apex angle in the range of 30° to 60° and a length on the order of ⅜ inch measured along said side edges.

7. A liquid dispenser according to claim 1, wherein:

said septum comprises a relatively flat disc.

8. A liquid dispenser according to claim 1, wherein:

said septum has a central cavity opening outwardly and bounded at its inner end by an end wall containing said slit formation.

9. A flap valve insert for a squeeze bottle liquid dispenser, comprising:

a septum of relatively thin resiliently flexible material;

said septum containing a 90° butt cut slit formation defining a resiliently flexible tongue-like valve flap integrally joined along a hinge line area to the septum proper for deflection of said flap from the plane of said septum to provide a liquid flow opening in the septum complemented by said flap;

said valve flap having a normal unstressed position within said septum liquid flow opening substantially coplanar with said septum wherein said flap seals said opening against liquid passage therethrough;

and an air flow opening in said septum of a cross-sectional area that is non-porous with respect to the passage of a liquid to be contained in the dispenser.

10. A flap valve insert according to claim 9, wherein:

said air flow opening is in said hinge line area of said valve flap.

11. A flap valve insert according to claim 9 wherein:

said slit formation defines two opposite equal included angle areas on the order of 55° constituting a pair of said valve flaps.

12. A flap valve insert according to claim 11, wherein:

said septum has a plurality of said air flow openings.

13. A flap valve insert according to claim 12, wherein:

each of said air flow openings is intersected by a terminal end of a slit of said slit formation.

14. A flap valve insert according to claim 9, wherein:

said septum comprises a relatively flat circular disc of polyethylene plastic on the order of 0.020 inches in thickness.

* * * * *